US007677697B2

(12) United States Patent
Ozawa et al.

(10) Patent No.: US 7,677,697 B2
(45) Date of Patent: Mar. 16, 2010

(54) DROPLET DISCHARGING HEAD WITH A THROUGH HOLE HAVING A PROTRUSION ON A SURFACE, DROPLET DISCHARGING DEVICE AND A FUNCTIONAL-FILM FORMING DEVICE

(75) Inventors: Kinya Ozawa, Suwa (JP); Shinri Sakai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 450 days.

(21) Appl. No.: 11/677,160

(22) Filed: Feb. 21, 2007

(65) Prior Publication Data

US 2007/0200896 A1 Aug. 30, 2007

(30) Foreign Application Priority Data

Feb. 28, 2006 (JP) ..... 2006-052466
Nov. 8, 2006 (JP) ..... 2006-302546

(51) Int. Cl.
*B41J 2/14* (2006.01)
*B41J 2/16* (2006.01)

(52) U.S. Cl. ..... 347/47; 347/44

(58) Field of Classification Search ..... 347/20, 347/44, 47, 68, 70–72
See application file for complete search history.

(56) References Cited

U.S. PATENT DOCUMENTS 6,132,028 A * 10/2000 Su et al. ..... 347/47
6,749,283 B2 * 6/2004 Sanada ..... 347/47
7,207,648 B2 * 4/2007 Kojima et al. ..... 347/47

FOREIGN PATENT DOCUMENTS

JP A 08-318628 12/1996
JP A 2001-329392 11/2001
JP A 2002-059551 2/2002
JP A 2002-127430 5/2002
JP A 2002-210965 7/2002
JP A 2004-009677 1/2004
JP A 2005-186494 7/2005
JP A 2006-069168 3/2006

* cited by examiner

*Primary Examiner*—Juanita D Stephens
(74) *Attorney, Agent, or Firm*—Oliff & Berridge, PLC

(57) ABSTRACT

A droplet discharging head includes a first through hole having an outlet for discharging of a liquid material and a second through hole having an inlet for injection of the liquid material, the second through hole having a protrusion on surface.

14 Claims, 9 Drawing Sheets

DROPLET DISCHARGING HEAD WITH A THROUGH HOLE HAVING A PROTRUSION ON A SURFACE, DROPLET DISCHARGING DEVICE AND A FUNCTIONAL-FILM FORMING DEVICE

BACKGROUND OF THE INVENTION

1. Technical Field

Several aspects of the present invention relate to a droplet discharging head, a droplet discharging device and a functional-film forming device.

2. Related Art

A droplet discharging device with an inkjet head is increasingly used as a functional-film forming device for industrial use, in addition to its use for printing letters and images by means of an image forming device such as an inkjet printer. Specifically, a functional-film forming device is used for discharging liquid materials including organic and inorganic materials in order to form, for example, a functional film such as a semiconductor film, a conductive film or an insulating film on a substrate.

JP-A-2002-127430 is an example of related art, disclosing a technology that concerns an inkjet head to improve the landing precision of ink. However, when viscosity increases in a liquid material discharged from the droplet discharging device, the straight moving property of the discharged droplet deteriorates, thus reducing its landing precision.

SUMMARY

An advantage of the present invention is to provide a droplet discharging head, a droplet discharging device and a functional-film forming device that are capable of enhancing the landing precision.

A droplet discharging head according to a first aspect of the invention includes a first through hole having an outlet for discharging of a liquid material and a second through hole having an inlet for injection of the liquid material. The second through hole is provided with protrusions on its surface.

A droplet discharging head according to a second aspect of the invention includes (1) a base body that includes a cavity for holding of a liquid material and a nozzle portion for discharging of the liquid material from the cavity, the cavity and the nozzle portion having been formed in the base body, and (2) a control portion that is placed on the cavity and controls the discharging of the liquid material. The nozzle portion includes a first through hole with an outlet for discharging of the liquid material and a second through hole with an inlet for injection thereof. The second through hole has a plurality of protrusions formed on its surface.

This enhances, through the rectifying effect of the protrusions, the straight moving property of the liquid material flowing in the nozzle portion, thereby improving the landing precision of the droplets discharged from the outlet even in cases where the liquid material being discharged has a relatively high viscosity, as in the case of an organic solvent, a high polymer material, or the like.

In the above droplet discharging head, it is preferable that the sectional area of the protrusions be larger toward the outlet than toward the inlet. This enhances the rectifying effect.

In the above droplet discharging head, it is preferable that the second through hole have a tapered shape.

In the above droplet discharging head, it is preferable that the second through hole have a columnar shape.

A droplet discharging head according to a third aspect of the invention has a through hole that includes an outlet for discharging of a liquid material and an inlet for injection thereof. The through hole has protrusions on its surface, the protrusions each having a larger sectional area toward the outlet than toward the inlet.

A droplet discharging head according to a fourth aspect of the invention has (1) a base body that includes a cavity for holding of a liquid material and a nozzle portion for discharging of the liquid material from the cavity, the cavity and the nozzle portion having been formed in the base body, and (2) a control portion that is placed on the cavity and controls the discharging of the liquid material. The nozzle portion has an outlet for discharging of the liquid material and an inlet for injection thereof and is provided with protrusions on its surface, the protrusions each having a larger sectional area toward the outlet than toward the inlet.

This enhances, through the rectifying effect of the protrusions, the straight moving property of the liquid material flowing in the nozzle portion, thereby improving the landing precision of the droplets discharged from the outlet even in cases where the liquid material being discharged has a relatively high viscosity, as in the case of an organic solvent, a high polymer material, or the like. The protrusions provided at the outlet fixes the form of the droplets at the time when they are discharged so that their straight moving property is enhanced.

In the above droplet discharging head, it is preferable that the protrusions be formed in such a manner that their cross sections perpendicular to the flow path of the liquid material are symmetric in shape with respect to the lines passing through the center of the flow path.

In the above droplet discharging head, the protrusions may be formed in such a manner that their cross sections have a shape that includes an acute angle In the above droplet discharging head, the rectifying effect can be improved by forming each of the protrusions in a straight line running from its end at the inlet through to its other end at the outlet.

Alternatively, each of the protrusions may be formed in such a manner that its end at the inlet and its other end at the outlet are in a positional relationship that is out of alignment by an angle of 90 degrees.

In the above droplet discharging head, it is preferable that the control portion be a piezoelectric element that changes the volume of the cavity.

In the above droplet discharging head, it is preferable that the control portion be a heater that heats the cavity.

A droplet discharging device according to a fifth aspect of the invention is provided with the above droplet discharging head.

A functional-film forming device according to a sixth aspect of the invention is provided with the above droplet discharging head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the Invention will be Described.

First Embodiment

Figure 1:
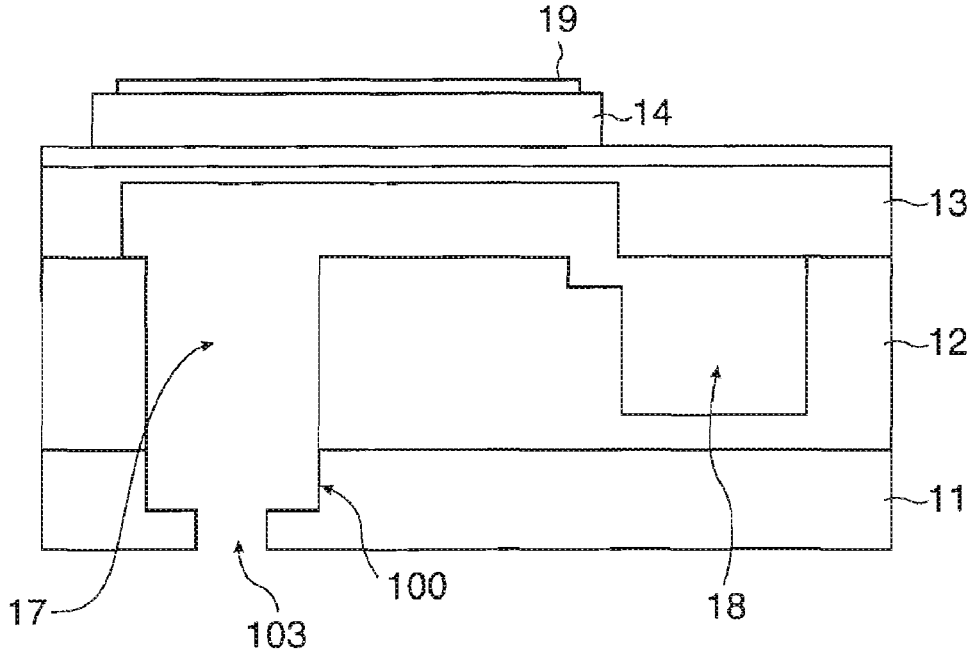
FIG. 1 is a sectional view schematically showing the structure of a droplet discharging head according to one embodiment of the invention.

FIG. 1 schematically shows the structure of a droplet discharging head 10 according to a first embodiment of the invention in its sectional view.

As shown in FIG. 1, the droplet discharging head 10 is provided with a nozzle plate 11, a flow path substrate 12, a diaphragm 13, a piezo (piezoelectric element) 14 and an electrode 19. For example, a nozzle portion 100 is formed in the nozzle plate 11 while a cavity 17 and a reservoir 18 are formed in the flow path substrate 12. The nozzle plate 11 and the flow path substrate 12 may be formed either separately or integrally.

Here, the nozzle portion 100 represents part of a base body having a structure to discharge a liquid material, which includes the nozzle plate 11, and mainly refers to the part which the liquid material lastly passes through before it is discharged. It does not always take the form of a through hole, but in FIG. 1 it forms a through hole.

On the other hand, the cavity 17 represents part of a base body having a structure to hold a liquid material, which includes the flow path substrate 12, and mainly refers to the part that is changed in volume by the electrostrictive effect of the piezoelectric element.

Figure 2:
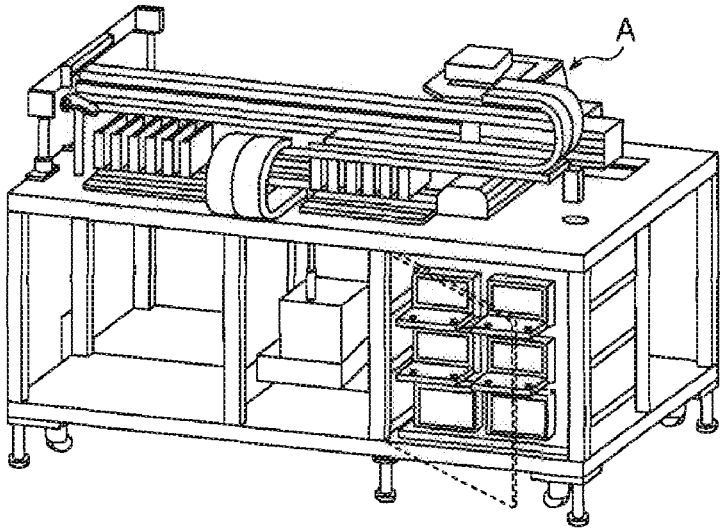
FIG. 2 is a schematic showing the structure of a droplet discharging device according to one embodiment of the invention.

The droplet discharging head 10 is placed, for example, in a head unit portion (represented by A in FIG. 2) of a droplet discharging device shown in FIG. 2. The droplet discharging device is used not only for the discharging of image forming inks but also for the discharging of functional film forming inks employed in a variety of industrial uses including, for example, the discharging of organic solvents onto silicon substrates or the discharging of high polymer materials. Functional-film forming inks including organic solvents and high polymer materials typically are liquid materials having a high viscosity as compared to image forming inks.

A liquid material, being brought from an external feeding unit into the droplet discharging head 10 via a material inlet (not illustrated), fills the space forming the reservoir 18, the cavity 17 and the nozzle portion 100. Subsequently, electric signals, being propagated from the electrode 19 to the piezo 14, causes a flexure to occur in the piezo 14 and the diaphragm 13, increasing the pressure inside the cavity 17 for a moment, thereby causing droplets to be discharged from the nozzle hole of the nozzle portion 100.

Figure 3A:
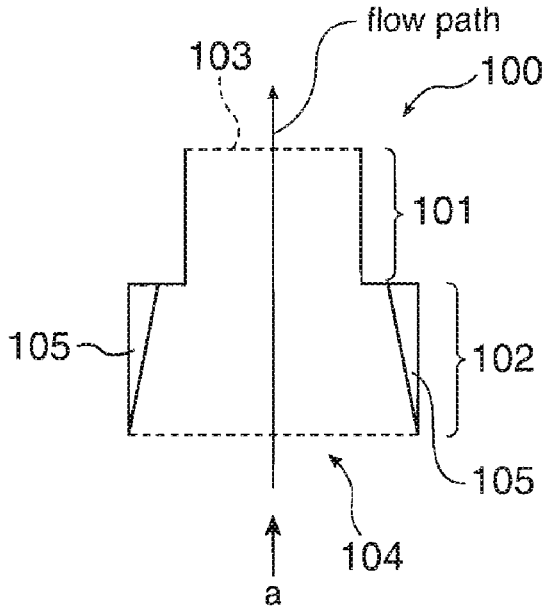
FIG. 3A is a schematic showing a section, being parallel to the flow path of droplets, of a nozzle portion in a droplet discharging head according to a first embodiment of the invention.
Figure 3B:
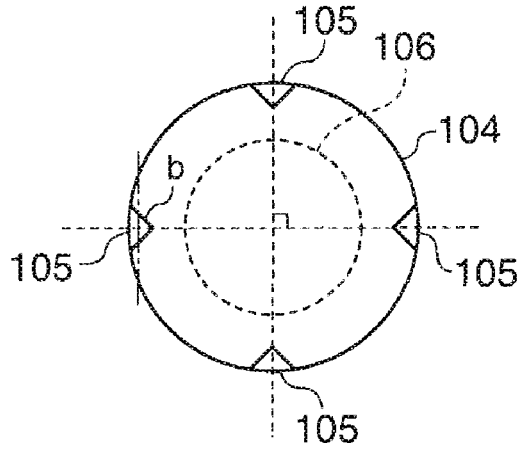
FIG. 3B is a plan view schematically showing the nozzle portion when it is observed from the direction a shown in FIG. 3A.

FIGS. 3A and 3B schematically show the shape of the nozzle portion 100 in the droplet discharging head 10 in its sectional views, FIG. 3A showing a section that is parallel to the flow path of the liquid material and FIG. 3B representing a plan view observed from the direction a shown in FIG. 3A.

As shown in FIGS. 3A and 3B, the nozzle portion 100 includes an outer nozzle hole (first through hole) 101 and an inner nozzle hole (second through hole) 102. The outer nozzle hole 101 has a droplet outlet 103 for discharging of droplets toward outside. The inner nozzle hole 102 has a droplet inlet 104 that leads to the cavity 17.

On the inside wall of the inner nozzle hole 102, protrusions 105 are formed. The protrusions 105 have an advantageous effect of rectifying the liquid material flowing in the inner nozzle hole 102.

The protrusions 105 are formed in such a manner that the areas of their cross sections shown in FIG. 3B, are the larger, the nearer the cross sections are to the droplet outlet 103. In addition, as the figure shows, the end portions b of the cross sections have a triangular shape with an acute angle (preferably 60° or less).

The protrusions 105 are arranged in such a manner that their positions divide the inner circumference of the inner nozzle hole 102 into quarters. The number of the protrusions 105 is not limited to four, but it is preferable that the cross section of the inner nozzle hole 102, which is perpendicular to the flow path of the liquid material, have a symmetric shape with respect to the lines passing through the center of the flow path.

Meanwhile, a broken line 106 in FIG. 3B shows a cross section of the outer nozzle hole 101. In FIG. 3B, the protrusions 105 are placed in the inner nozzle hole 102 without overlapping the outer nozzle hole 101.

The nozzle portion 100 according to the first embodiment can be formed by electroforming using nickel, cobalt, manganese or alloys of those metals. Alternatively, the nozzle plate 11 and the flow-path forming substrate 12 may be integrally formed by photolithography using a silicon substrate. Whereas it is preferable that the protrusions 105 be 10 to 20 μm thick, those with thinner shapes are more easily formed by electroforming while thicker ones are more easily formed by photolithography.

Figure 4A:
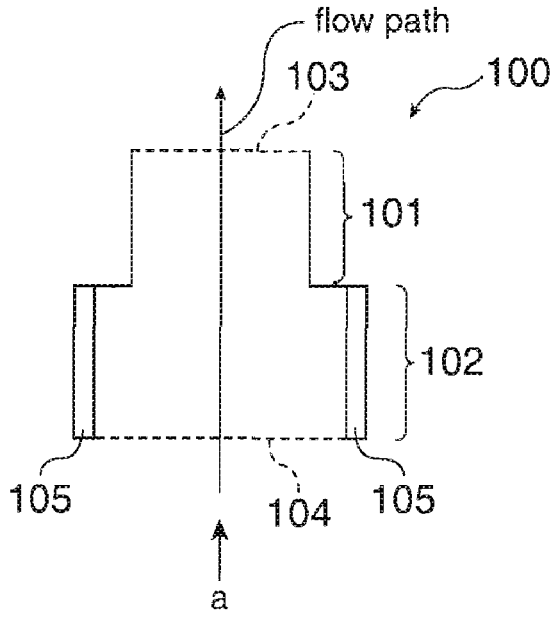
FIG. 4A is a schematic showing a section, being parallel to the flow path of droplets, of a nozzle portion in a droplet discharging head according to a modification of the first embodiment.
Figure 4B:
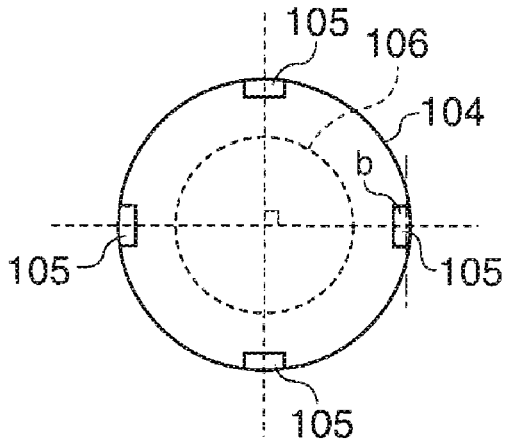
FIG. 4B is a plan view schematically showing the nozzle portion when it is observed from the direction a shown in FIG. 4A.

FIGS. 4A and 4B are sectional views showing the shape of the nozzle portion 100 in the droplet discharging head 10) according to a modification of the first embodiment. FIG. 4A is a schematic showing its section that is parallel to the flow path of the liquid material, and FIG. 4B is a plan view of its cross section observed from the direction a shown in FIG. A.

The nozzle portion 100 shown in FIGS. 3A and 3B and the nozzle portion 100 shown in FIGS. 4A and 4B are of different shapes.

In the example of FIGS. 4A and 4B, the protrusions 105 are formed in such a way that their cross sections being perpendicular to the flow path each has a constant dimension. Furthermore, the end portions b of the cross sections each has a quadrangular shape, as shown therein. The protrusions 105 are arranged in such a manner that their positions divide the inner circumference of the inner nozzle hole 102 into quarters, but the number of the protrusions 105 is not limited to four. It is preferable that a cross section of the inner nozzle hole 102, being perpendicular to the flow path of the liquid material, be of a symmetric shape with respect to the lines passing through the center of the flow path. Meanwhile, the broken line 106 in FIG. 4B shows the cross section of the outer nozzle hole 101. In FIG. 4B, the protrusions 105 are located in the inner nozzle hole 102 without overlapping the outer nozzle hole 101. The protrusions 105 shown in FIGS. 4A, 4B have a shape that allows them to be formed more easily by photolithography, as compared with the protrusions in FIG. 3A, 3B.

The first embodiment of the invention allows the straight moving property of the liquid material flowing in the nozzle portion 100 to be enhanced by the rectifying effect of the protrusions 105 provided on the inside wall of the inner nozzle hole 102. Consequently, the embodiment allows the landing precision of droplets discharged from the droplet outlet 103 to be improved even in cases where the droplets being discharged are made of a liquid material with a relatively high viscosity; as in the case of an organic solvent or a high polymer material. It is also effective for discharging of smaller droplets.

Figure 7A:
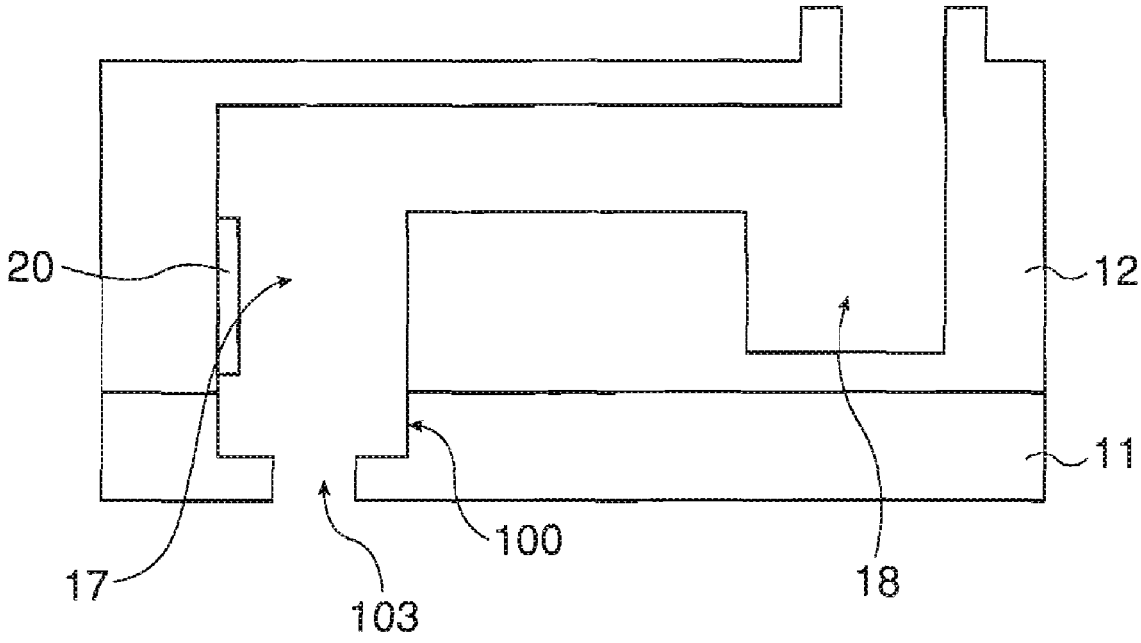
FIG. 7A is a sectional view schematically showing another example of the structure of the droplet discharging head according to one embodiment of the invention.
Figure 7B:
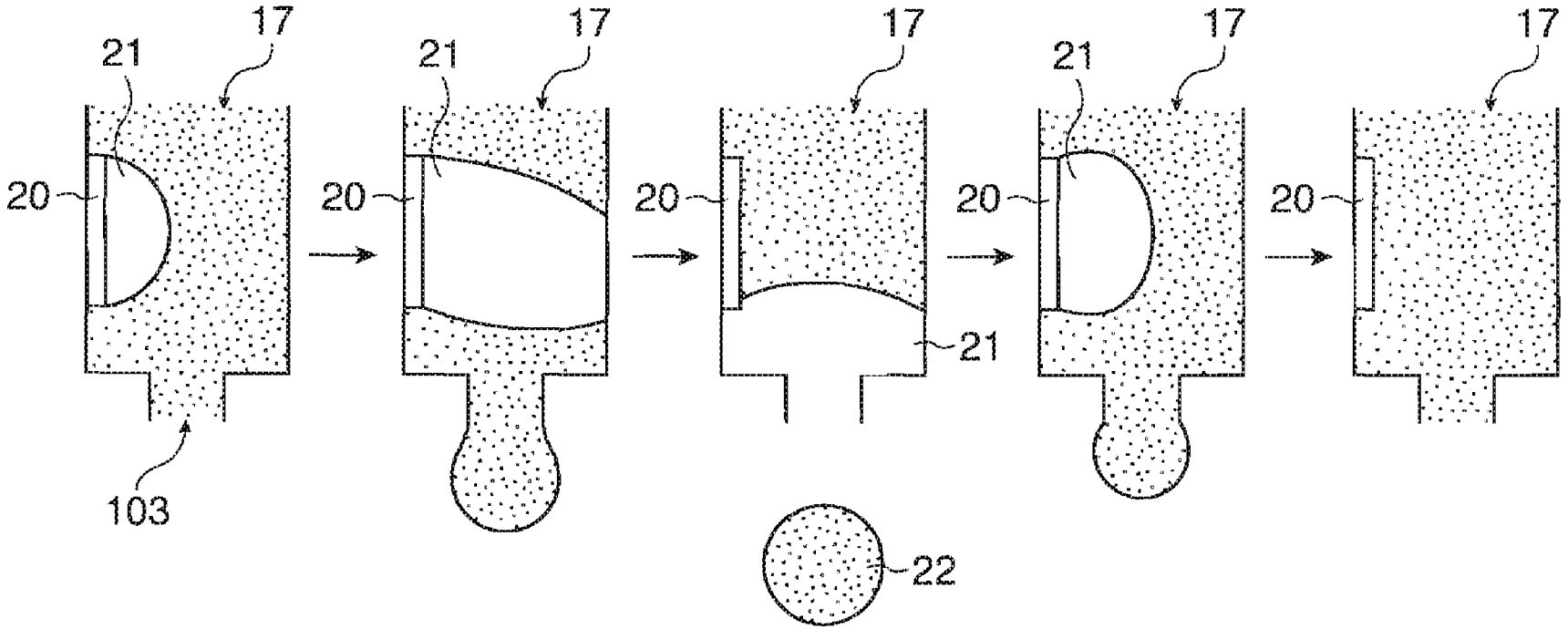
FIG. 7B is a sectional view schematically showing details of a control portion according to the above example.

The droplet discharging head 10 according to the first embodiment employs the piezo 14 as a control portion for discharging of the liquid material from the nozzle hole. However, the control portion is not limited to the piezo alone. Any other portion may be employed if it discharges a liquid material. For example, as shown in FIGS. 7A and 7B the control portion may be one using a heater 20. In this case, as shown in FIG. 7B, the heater 20 heats the cavity 17, creating a bubble 21 in the liquid material ill the cavity 17, thereby causing droplets 22 to be discharged from the droplet outlet 103.

Second Embodiment

Figure 5A:
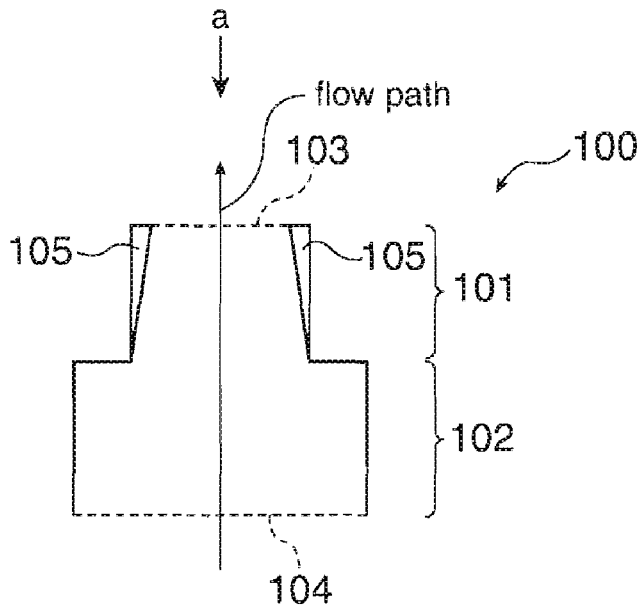
FIG. 5A is a schematic showing a section, being parallel to the flow path of droplets, of a nozzle portion of a droplet discharging head according to a second embodiment of the invention.
Figure 5B:
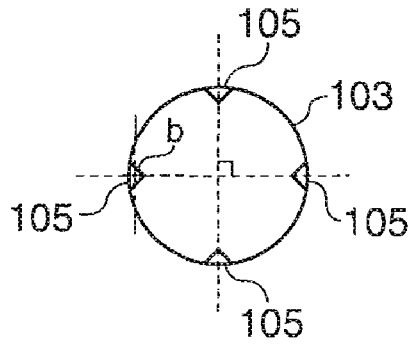
FIG. 5B is a plan view schematically showing the nozzle portion when it is observed from the direction a shown in FIG. 5A.

FIGS. 5A and 5B show the shape of the nozzle portion 100 of the droplet discharging head 101 in its sectional views. FIG. 5A is a schematic of its section that is parallel to the flow path of the liquid material and FIG. 5B is a plan view of its cross section observed from the direction a shown in FIG. 5A.

In the second embodiment, the protrusions 105 are provided on the inside wall of the outer nozzle hole 101 in the nozzle portion 100. The protrusions 105 are formed in such a way that the area of each of their cross sections is the larger, the nearer the cross sections are to the droplet outlet 103. The end portions b have a triangular shape with an acute angle (preferably 60° or less).

Furthermore, the protrusions 105 are arranged in such a manner that their positions divide the inner circumference of the outer nozzle hole 101 into quarters. The number of the protrusions 105 is not limited to four, but it is preferable that their cross sections perpendicular to the flow path of the liquid material in the droplet discharging head 10 be of a symmetric shape with respect to the lines passing through the center of the flow path of the liquid material.

The nozzle portion 100 can be formed by electroforming with a metal such as nickel, cobalt, manganese or an alloy of those metals, in the same way as in the first embodiment. Alternatively, it may be integrally formed on a silicon substrate forming the nozzle plate 11 by means of photolithography. Whereas it is preferable that the protrusions 105 have a thickness of 10 to 20 μm, those with thinner shapes are more easily formed by electroforming while thicker ones are more easily formed by photolithography.

Figure 6A:
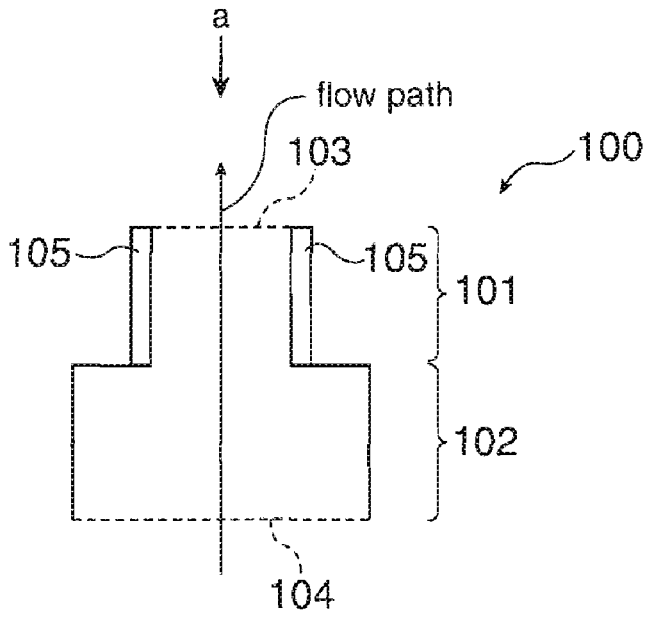
FIG. 6A is a schematic showing a section, being parallel to the flow path of droplets, of a nozzle portion of a droplet discharging head according to a modification of the second embodiment.
Figure 6B:
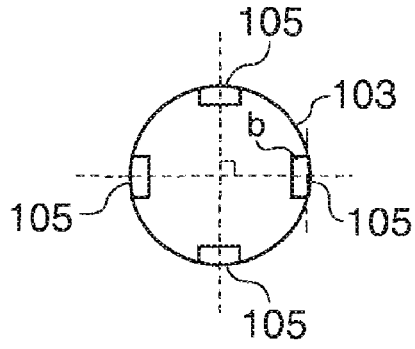
FIG. 6B is a plan view schematically showing the nozzle portion when it is observed from the direction a shown in FIG. 6A.

Furthermore, FIGS. 6A and 6B show, in sectional views, the shape of the nozzle portion 100 in the droplet discharging head 10 according to a modification of the second embodiment. FIG. 6A shows its section that is parallel to the flow path of the liquid material, while FIG. 6B is its plan view observed from the direction a shown in FIG. 6A.

The nozzle portion 100 in FIGS. 6A and 6B and the nozzle portion 100 in FIGS. 6A and 6B are of different shapes.

In the example of FIGS. 6A and 6B, the protrusions 105 are formed in such a manner that each of their cross sections being perpendicular to the flow path has a constant dimension. Furthermore, as shown in FIG. 6B, the end portion b of each of the cross sections is in a quadrangular shape. The protrusions 105 are arranged in such a way that their positions divide the inner circumference of the outer nozzle hole 101 into quarters, but the number of the protrusions 105 is not limited to four. It is preferable that the cross section of the outer nozzle hole 101, being perpendicular to the flow path of the liquid material, have a symmetric shape with respect to the lines passing through the center of the flow path of the liquid material. The shape of the protrusions 105 shown in FIGS. 6A and 6B facilitates their formation by photolithography, as compared with the shape of those in FIGS. 5A and 5B.

The second embodiment of the invention allows the straight moving property of the liquid material to be enhanced, because its flow in the nozzle portion 100 is rectified by the protrusions 105 provided on the inside wall of the outer nozzle hole 101. Thus, the embodiment allows the landing precision of droplets discharged from the droplet outlet 103 to be improved even in cases where the liquid material being discharged has a relatively high viscosity or elasticity, as in the case of an organic solvent or a high polymer material. It is also effective for discharging of smaller droplets. In addition, provision of the protrusions 106 at the droplet outlet 103 enhances the straight moving property of droplets, because the droplets are rectified at the droplet outlet 103 at the time when they are discharged.

Third Embodiment

The protrusions 105 are formed only in the inner nozzle hole 102 in the first embodiment, and only in the outer nozzle hole 101 in the second embodiment, but the protrusions 105 may be provided along the entire length of the inside wall of the nozzle portion 100, all through the outer nozzle hole 101 and the inner nozzle hole 102.

In a third embodiment, as well, the protrusions 105 are formed in such a way that the area of each of their cross sections is the larger, the nearer the cross sections are to the droplet outlet 103, as in the examples of FIGS. 3A and 3B as well as FIGS. 5A and 5B. Or, the protrusions 105 are formed in such a manner that their cross sections perpendicular to the flow path are of a constant dimension, as in the examples of FIGS. 4A and 4B as well as FIGS. 6A and 6B. The end portions b of the cross sections may each has a triangular shape with an acute angle (preferably 60° or less), as in the examples of FIGS. 3A and 3B as well as FIGS. 5A and 5B, or a quadrangular shape, as in the examples of FIGS. 4A and 4B as well as FIGS. 6A and 6B. End portions having a curved section are also effective.

The number of the protrusions 105 may be any, but it is preferable that the cross section of the nozzle portion 100, being perpendicular to the flow path of the liquid material, be in a symmetric shape with respect to the lines passing through the center of the flow path of the liquid material.

The protrusions 105 are allowed to have a higher rectifying effect if they are made to form straight lines running from the droplet outlet 103 through to the droplet inlet 104. That means, it is preferable that the protrusions 105 provided in the outer nozzle hole 101 and the protrusions 105 provided in the inner nozzle hole 102 be arranged in alignment with each other.

Alternatively, the protrusions 105 may be each formed in such a manner that an end thereof at the droplet outlet 103 and another end thereof at the droplet inlet 104 are in a positional relationship that is out of alignment by an angle of 90 degrees. That is, the protrusions 105 provided in the outer nozzle hole 101 and the protrusions 105 provided in the inner nozzle hole 102 are arranged to be in a positional relationship forming an angle of 90 degrees with each other.

Figure 8A:
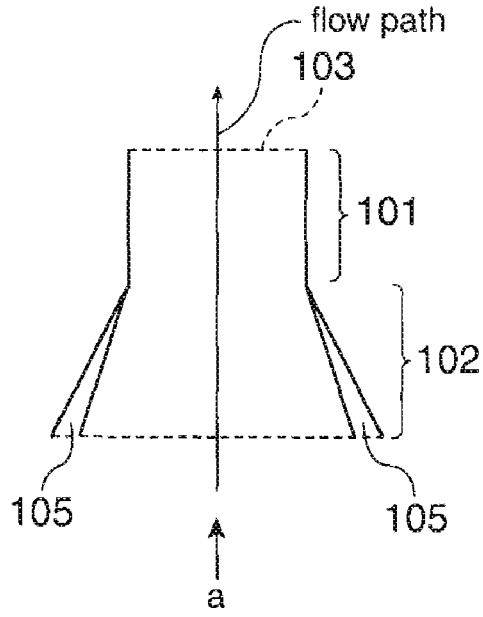
FIG. 8A is a sectional view schematically showing another example of the shape of an inner nozzle hole 102 of a droplet discharging head according to one embodiment of the invention.
Figure 8B:
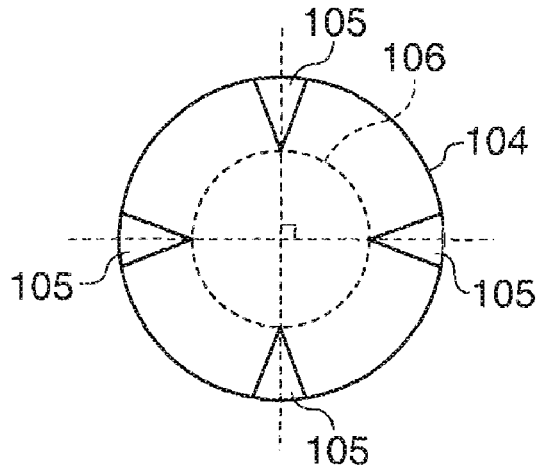
FIG. 8B is a plan view schematically showing the inner nozzle hole 102 of the above example when it is observed from the direction a shown in FIG. 8A.

In each of the embodiments described above, the outer nozzle hole 101 and the inner nozzle hole 102 are each in a columnar shape, but their shapes are not limited to columnar shapes. For example, as shown in FIGS. 8A and 8B, the inner nozzle hole 102 may have a tapered shape. In this case, the inner nozzle hole 102 gradually becomes smaller in diameter from the cavity 17 toward the droplet outlet 103. Therefore, it is not necessary here that the protrusions 105 are formed in such a way that their cross sections perpendicular to the flow path grows larger in diameter toward the droplet outlet 103.

Fourth Embodiment

Figure 9A:
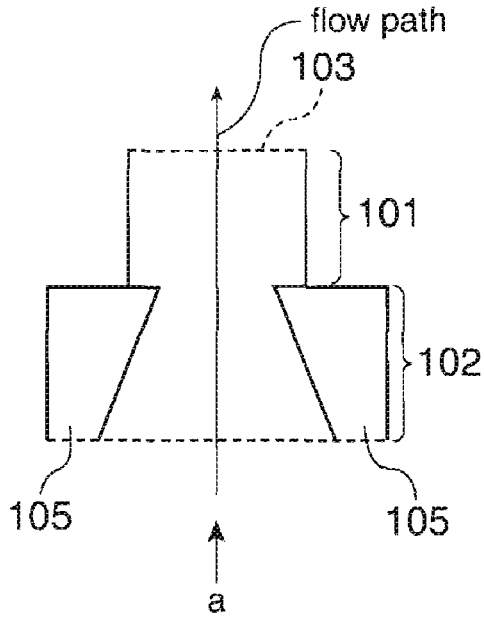
FIG. 9A is a schematic showing a section, being parallel to the flow path of droplets, of a nozzle portion of a droplet discharging head according to a fourth embodiment of the invention.
Figure 9B:
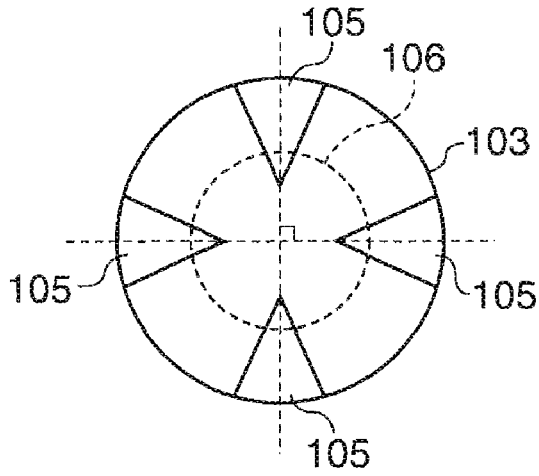
FIG. 9B is a plan view schematically showing the nozzle portion of the fourth embodiment when it is observed from the direction a shown in FIG. 9A.

A fourth embodiment of the invention is a modification of the first embodiment. FIGS. 9A and 9B show the shapes of sections of the nozzle portion 100 in the droplet discharging head 10 according to the fourth embodiment. FIG. 9A is a schematic of its section that is parallel to the flow path of the liquid material, and FIG. 9B is a plan view showing its cross section observed from the direction a shown in FIG. 9A.

The nozzle portion 100 shown in FIGS. 9A and 9B have protrusions 105 of a shape that is different from the shape of the protrusions in the nozzle portion 100 of the first embodiment shown in FIGS. 3A and 3B. Namely, the protrusions 105 in FIGS. 9A and 9B stick out to overlap the broken line 106 that represents the cross section of the outer nozzle 101. That means that the protrusions 105 are arranged in such a manner that their cross sections perpendicular to the flow path form together an internal diameter that is smaller than the internal diameter of the outer nozzle 101. This reduces the shift in volume occurring at the border between the outer nozzle 101 and the inner nozzle 102, thereby further enhancing the stability of the discharging of droplets.

The entire disclosure of Japanese Patent Application Nos. 2006-052466, filed Feb. 28, 2006 and 2006-302546, filed Nov. 8, 2006 are expressly incorporated by reference herein.

What is claimed is:

1. A droplet discharging head, comprising:

a first through hole with an outlet for discharging of a liquid material; and a second through hole with an inlet for injection of the liquid material, at least one of the first through hole and the second through hole having protrusions toward a center line of the hole from an inside wall of the hole, the protrusions are separately distributed along a circumferential direction in the hole and are continuously distributed along the center line of the hole.

2. The droplet discharging head according to claim 1, at least one of the plurality of protrusions having a larger sectional area toward the outlet than toward the inlet.

3. The droplet discharging head according to claim 1, the second through hole having a tapered shape.

4. The droplet discharging head according to claim 1, the second through hole having a columnar shape.

5. The droplet discharging head according to claim 1, at least one of the plurality of protrusions including a cross section perpendicular to a flow path of the liquid material, the cross section having a symmetric shape with respect to a line passing through center of the flow path.

6. The droplet discharging head according to claim 1, at least one of the plurality of protrusions including a cross section perpendicular to the flow path, the cross section having a shape that includes an acute angle.

7. The droplet discharging head according to claim 1, at least one of a plurality of protrusions being formed in a straight line running from an end at the inlet through to another end at the outlet.

8. The droplet discharging head according to claim 1, at least one of a plurality of protrusions having an end at the inlet and another end at the outlet, the ends being in a positional relationship that is out of alignment by an angle of about 90 degrees.

9. The droplet discharging head according to claim 1, the control portion being a piezoelectric element that changes volume of the cavity.

10. The droplet discharging head according to claim 1, the control portion being a heater that heats the cavity.

11. A droplet discharging device comprising the droplet discharging head according to claim 1.

12. A functional-film forming device comprising the droplet discharging head according to claim 1.

13. A droplet discharging head, comprising:

a base body that includes a cavity for holding of a liquid material and a nozzle portion for discharging of the liquid material from the cavity, the nozzle portion having a first through hole with an outlet for discharging of the liquid material and a second through hole with an inlet for injection of the liquid material, at least one of the first through hole and the second through hole having protrusions toward a center line of the hole from an inside wall of the hole, and the protrusions are separately distributed along a circumferential direction in the hole and are continuously distributed along the center line of the hole; and a control portion that is placed on the cavity and controls the discharging of the liquid material.

14. A droplet discharging head comprising:

a base body that includes a cavity for holding of a liquid material and a nozzle portion for discharging of the liquid material, the nozzle portion including a through hole that has an outlet for discharging of the liquid material and an inlet for injection of the liquid material, the through hole having a plurality of protrusions from a center line of the hole to an inside wall of the hole, and each of the plurality of protrusions having a larger sectional area toward the outlet than toward the inlet; and a control portion that is placed on the cavity and controls the discharging of the liquid material.

* * * * *